US008209791B2

(12) United States Patent
Williams

(10) Patent No.: US 8,209,791 B2
(45) Date of Patent: Jul. 3, 2012

(54) TOILET LEAK ALERT

(76) Inventor: David W. Williams, La Porte, TX (US)

( * ) Notice: Subject to any disclaimer, the term of this patent is extended or adjusted under 35 U.S.C. 154(b) by 363 days.

(21) Appl. No.: 12/494,007

(22) Filed: Jun. 29, 2009

(65) Prior Publication Data

US 2010/0000013 A1 Jan. 7, 2010

Related U.S. Application Data

(60) Provisional application No. 61/077,208, filed on Jul. 1, 2008.

(51) Int. Cl.
*E03D 1/00* (2006.01)

(52) U.S. Cl. ..... 4/314

(58) Field of Classification Search ..... 4/314
See application file for complete search history.

(56) References Cited

U.S. PATENT DOCUMENTS

| | | | | |
|---|---|---|---|---|
| 2,004,502 | A * | 6/1935 | Fieberling | 116/206 |
| 3,984,877 | A * | 10/1976 | Kirby | 4/314 |
| 6,671,893 | B1 * | 1/2004 | Quintana et al. | 4/427 |
| 6,802,084 | B2 * | 10/2004 | Ghertner et al. | 4/314 |
| 2005/0241054 | A1 * | 11/2005 | McKenna et al. | 4/427 |
| 2006/0168716 | A1 * | 8/2006 | Schuster et al. | 4/415 |

* cited by examiner

*Primary Examiner* — Gregory Huson
*Assistant Examiner* — Karen L Younkins

(57) ABSTRACT

Embodiments of the invention include devices for reliably indicating when the water level in a toilet tank rises to the top of the overflow tube. Indicators use the presence of water in the overflow to provide for visual, olfactory and/or auditory indication of the malfunction. Features of the invention provide for a safe, inexpensive and reliable device for detecting toilet malfunction. Indicators are housed in a device that is positioned to intercept overflow water passing from the toilet tank to the toilet bowl. The presence of water in the device housing is used to release indicators into the toilet bowl water or into the air. Improvements are provided that eliminate false positive indications and prevent inadvertent damage to the toilet.

3 Claims, 3 Drawing Sheets

TOILET LEAK ALERT

CROSS REFERENCE TO RELATED APPLICATION

This application claims the benefit of co-pending U.S. Provisional Patent Application Ser. No. 61,077,208 filed on Jul. 1, 2008, entitled "Flapper-Free Toilet Flusher and Leak Indicator" which is incorporated herein by reference.

BACKGROUND OF THE INVENTION

1. Field of the Invention

This application relates to a device that will signal a malfunction in a toilet, and more particularly to a device that provides a reliable indication that the water level in a toilet tank has risen to the top of the overflow tube.

2. Description of the Related Art

A typical flush toilet is comprised of a toilet tank and a toilet bowl. The toilet tank contains water, which, when a flush handle is depressed, flows into the toilet bowl through a toilet tank drain hole. Prior art has disclosed several means of flushing water into the toilet bowl, the most standard including the flapper method. According to this method, pushing the flush handle of the toilet lifts a flapper valve, allowing water in the toilet tank to flow through the flush valve and into the toilet bowl. This water forces waste water in the toilet bowl through the main drain. When the tank is empty, the flapper valve seals the toilet tank drain hole, allowing another device to refill the tank.

The tank refilling is controlled by an on-off water shutoff valve with a valve gasket, controlled through lever action by a flotation device. When the tank is full, the water level forces a flotation device to a level such that it shuts off the water refilling the toilet tank.

A number of common problems can cause the shutoff valve to stay open after it should close. For example, the gasket is a wear item needing periodic replacement. The shutoff valve mechanism can become stuck, and the float can lose buoyancy over time.

In some municipal water systems, the water pressure rises considerably during off peak hours. Water system pressure can rise by 15 to 20 pounds per square inch (psi), and by as much as 30 psi in some situations. This rise in pressure could cause the water level in the tank to rise. If the normal water level in the tank is set too close to the top of the overflow tube, the toilet will leak water into the overflow tube during these off peak periods.

Water in excess of the normal tank-full water level enters an overflow tube, which is connected to the toilet bowl. Thus excess water in the toilet tank enters the toilet bowl directly through the overflow tube rather than spilling out of the tank onto the floor.

A water leak through the overflow tube can go undetected and account for significant water loss, especially if the shutoff valve leak is relatively slow and noiseless.

The objective of the present invention is to provide a reliable visual, audible or olfactory indication that the water is flowing from the toilet tank to the toilet bowl through the overflow tube.

Previous attempts to solve this problem have shortcomings that are overcome by the present invention.

One problem is that the moisture content of the air in the toilet tank is relatively high. Most devices that rely on the presence of water to activate a leak indicator will yield false positive indications since the atmospheric moisture will initiate the activation process. For instance, some have suggested coating the upper interior region of the overflow tube with a water soluble chemical that will release an indicator in the presence of water. But a false positive indication is likely due to the degradation of any moisture barrier with prolonged exposure to high levels of atmospheric moisture found in the toilet tank.

Another problem results from indicators, barriers or chemicals falling or being forced into the overflow tube causing constrictions in the flow of water from the overflow tube to the toilet bowl. This can result in a toilet malfunction.

SUMMARY OF THE INVENTION

The present invention provides a reliable indication that the water level in a toilet tank has risen to the top of the overflow tube and water is being wasted.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments which are illustrated in the appended drawings.

It is to be noted, however, that the appended drawings illustrate only typical embodiments of this invention and are not to be considered limiting of its scope, for the invention may admit to other equally effective embodiments.

DETAILED DESCRIPTION OF EMBODIMENTS

Figure 1:
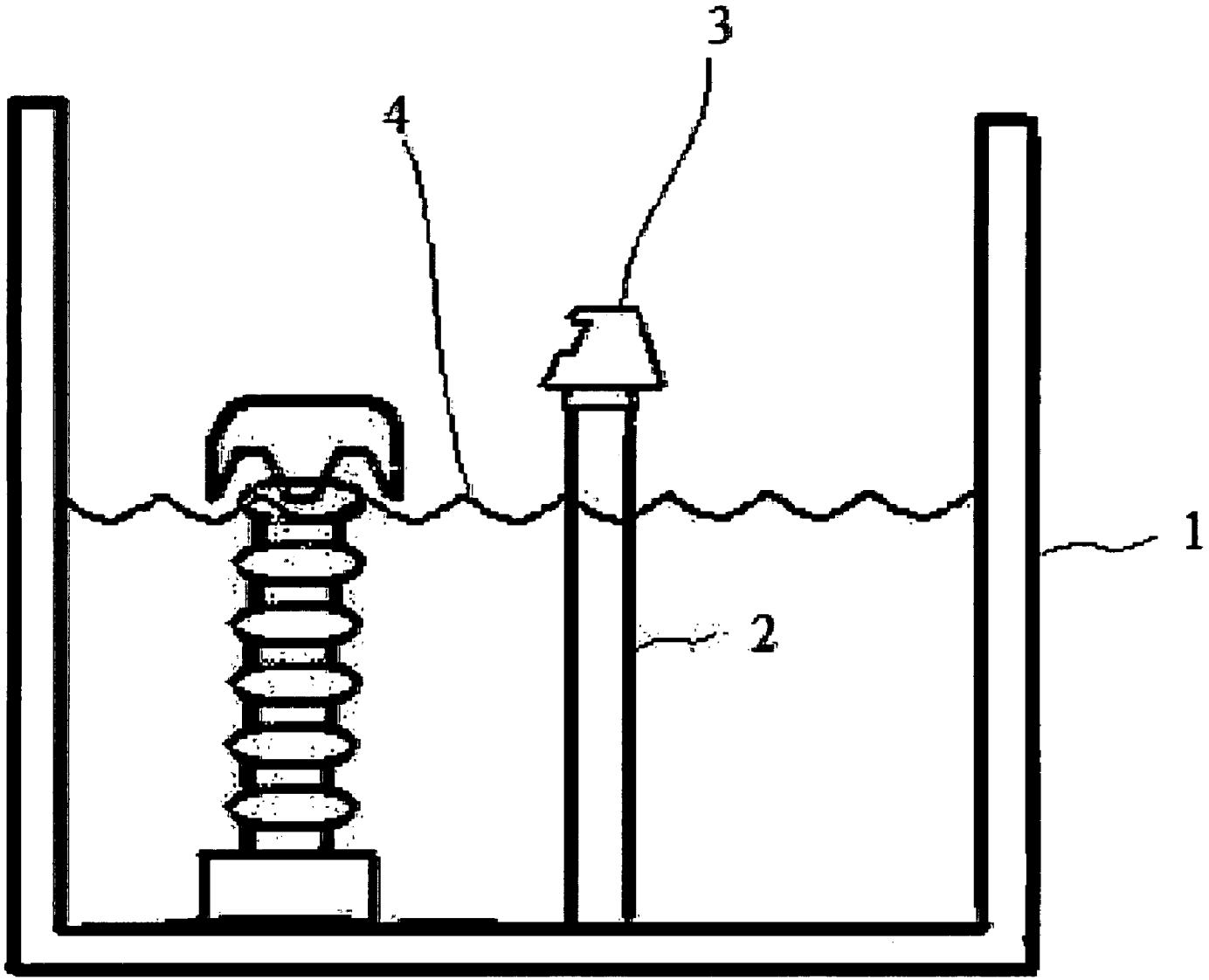
FIG. 1 schematically illustrates an embodiment of a toilet leak alert installed in a standard toilet tank 1. The toilet leak alert 3 is mounted on the overflow tube 2 so that when the water level 4 reaches the hole in the indicator housing, water flows through the hole and triggers an alert.
Figure 2:
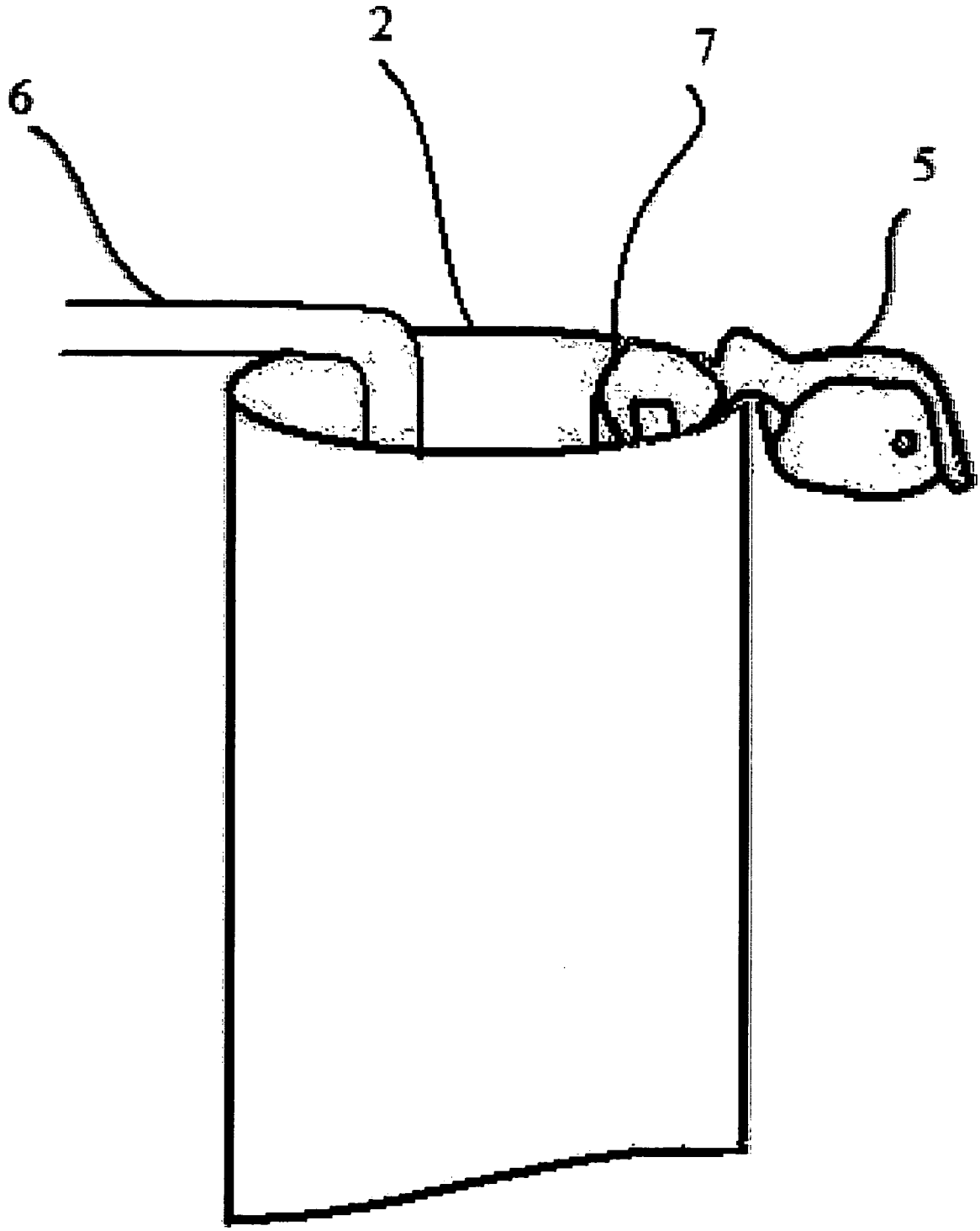
FIG. 2 is a block diagram of another embodiment of the toilet leak alert positioned on the inside of the overflow tube 2. This embodiment includes an oversized connector 5 used to attach the housing 7 to the inside of the overflow tube. The housing is sized to be small enough to allow enough room for the presence of a toilet bowl refill tube 6 within the overflow tube 2 along with the housing, but the size of the housing 7 and the connector 5 combined is too large to be inadvertently dropped into the overflow tube 2 causing potential constrictions and obstructions.
Figure 3:
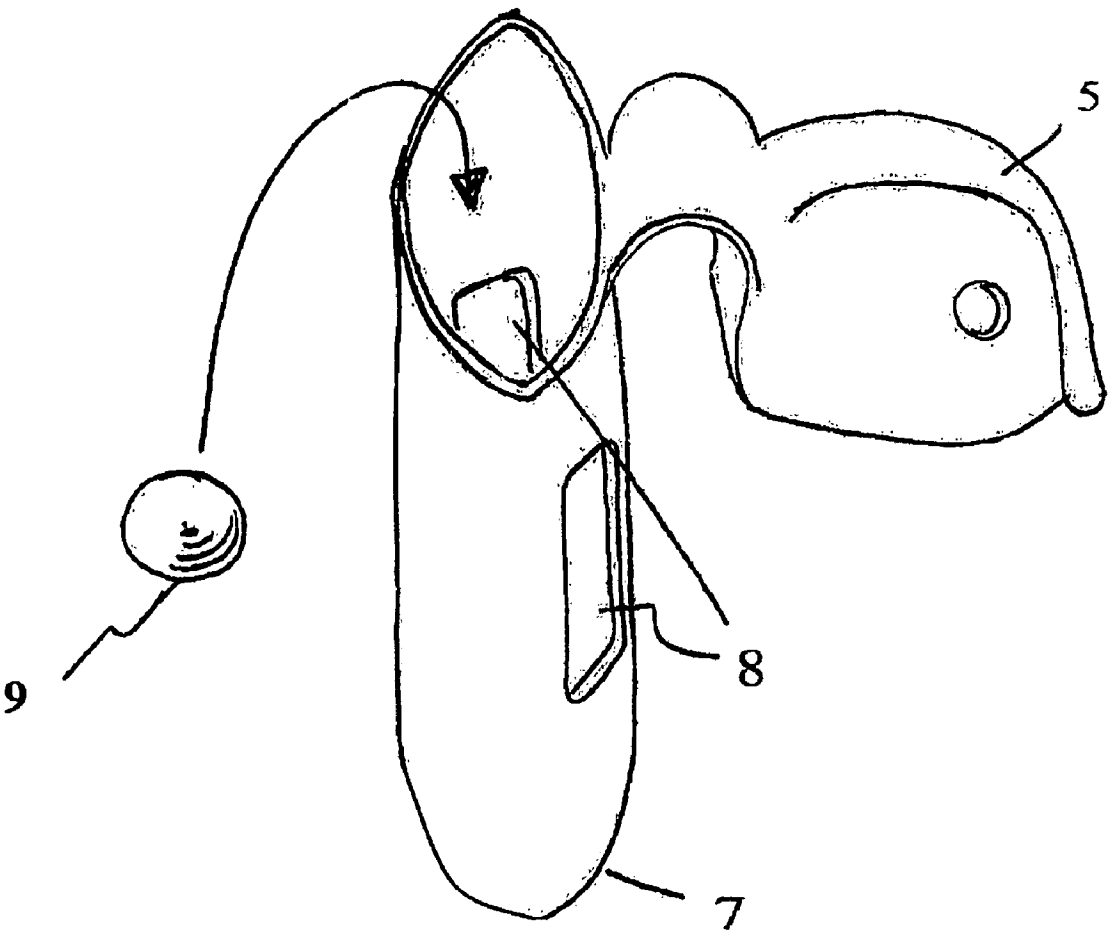
FIG. 3 is a schematic view of an embodiment of a toilet leak alert. This view shows the presence of exit ports 8 in the side of the housing 7 elevated above the bottom of the housing to accommodate containment of leakage from the indicator 9 caused by hydration of the indicator from atmospheric moisture.

In the following, reference is made to embodiments of the invention. However, it should be understood that the invention is not limited to specific described embodiments. Instead, any combination of the following features and elements, whether related to different embodiments or not, is contemplated to implement and practice the invention. Furthermore, in various embodiments the invention provides numerous advantages over the prior art. However, although embodiments of the invention may achieve advantages over other possible solutions and/or over the prior art, whether or not a particular advantage is achieved by a given embodiment is not limiting of the invention. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

The figures show embodiments of a reliable toilet leak alert comprised of a device housing 7 that is placed, hung, or otherwise mounted on top of or inside of an overflow tube 2 in a toilet tank 1, positioned such that it allows water flowing into or through the overflow tube to flow through or over the device. When water flows through the device, the water triggers one or multiple types of alerts 9 signaling a toilet malfunction. These alerts include, but are not limited to, visual (e.g. the device colors the water that moves into the toilet bowl), olfactory (e.g., a compound that gives off a distinctive smell when hydrated) and audible (e.g., a whistle).

A visual alert will be triggered when water covers the device. The visual indicator alert comprises a dissolvable compound that will release a color into the water. When water level in the tank rises above the top of the overflow tube, water will flow into the device housing. The indicator will then begin to dissolve, filling the bottom of the housing with colored water. When the water level in the housing rises above the height of the exit ports 8, the colored water will flow into the toilet bowl. The presence of colored water in the toilet bowl will provide a positive indication of a malfunction.

An olfactory alert will be triggered much the same way, but the indicator will release an odor into the atmosphere when in contact with the water entering the housing. The presence of the odor will provide a positive indication of the toilet malfunction.

An audible alert can be triggered by an electronic device that sounds an alarm in the presence of water. When the water enters into the housing, the electronic indicator will become immersed in water and will provide an audible positive indication of a malfunction.

In one embodiment of the invention, the device accommodates a variety of visual indicators 9. These indicators are preferably comprised of pellets of dissolvable compounds, so that water flowing though the device will hydrate the compounds and carry them into the toilet bowl. The housing is constructed to allow water in from the top to allow the water entering into the overflow tube to enter into the housing to make contact with the indicators. This can be achieved by leaving the top of the housing open, or constructing the top from some porous material. Further, the device is structured to contain the liquid resulting from the hydration of the indicator from atmospheric moisture present in a toilet bowl. This is done by providing a non porous volume of space below the exit ports 8 of the housing 7 which can contain any of the chemicals that leak from the indicator as a result of hydration from atmospheric moisture. High humidity in the toilet bowl may cause a breakdown of the moisture barrier of the indicator, but a false positive indication of a toilet malfunction will be avoided by containing the released indicator inside the non porous section of the device housing. When, however, the overflow indicator is properly installed in the appropriate place in or on an overflow tube, water flowing through the overflow tube will automatically and reliably broadcast its presence, signaling that maintenance is needed.

It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A toilet leak alert apparatus comprising:

A housing comprising an open top configured to capture water flowing into a toilet overflow tube, a side with an exit vent, and a bottom configured to hold water;

a connector attaching a top portion of said side of said housing configured as a clip for attaching said housing to an inside of a toilet overflow tube; and an indicator placed in said bottom of said housing comprising a soluble compound configured to release a dye or odor when water flows into said toilet overflow tube.

2. The toilet leak alert apparatus of claim 1 wherein said enclosed bottom is sized to contain at least 1 milliliter of water.

3. The toilet leak alert apparatus of claim 1 wherein each linear measurement of each cross sectional area of said toilet leak alert apparatus is at least 1 inch.

* * * * *